United States Patent [19]

Neuhaus

[11] Patent Number: 4,770,072

[45] Date of Patent: Sep. 13, 1988

[54] REVERSIBLE RATCHET WRENCH

[75] Inventor: Klaus Neuhaus, Wuppertal, Fed. Rep. of Germany

[73] Assignee: Eduard Wille GmbH & Co., Fed. Rep. of Germany

[21] Appl. No.: 109,502

[22] Filed: Oct. 16, 1987

Related U.S. Application Data

[63] Continuation of Ser. No. 816,149, Jan. 3, 1986, abandoned.

[30] Foreign Application Priority Data

Jan. 7, 1985 [EP] European Pat. Off. ..... 85710001.0

[51] Int. Cl.[4] ..... B25B 13/46

[52] U.S. Cl. ..... 81/63; 81/63.2

[58] Field of Search ..... 81/60, 61, 62, 63, 63.1, 81/63.2, 121.1

[56] References Cited

U.S. PATENT DOCUMENTS

| | | | |
|---|---|---|---|
| 2,058,855 | 10/1936 | Chapman | 81/63 |
| 2,701,977 | 2/1955 | Stone | 81/63.2 |
| 3,233,481 | 2/1966 | Bacon | 81/63 |
| 3,265,171 | 8/1966 | Kilness | 81/63 |
| 3,467,231 | 9/1969 | Haznar | 81/62 |
| 3,608,402 | 9/1971 | Rainey | 81/63.1 |
| 3,650,165 | 3/1972 | Wolfe | 81/63.2 |
| 4,277,989 | 7/1981 | Tracy | 81/62 |
| 4,277,990 | 7/1981 | Hall | 81/63 |
| 4,308,769 | 1/1982 | Rantanen | 81/63 |
| 4,488,460 | 12/1984 | Ballone et al. | 81/121.1 |

FOREIGN PATENT DOCUMENTS 2333615 1/1977 France .

*Primary Examiner*—Frederick R. Schmidt
*Assistant Examiner*—Maurina Rachuba
*Attorney, Agent, or Firm*—Mallinckrodt & Mallinckrodt

[57] ABSTRACT

A reversible ratchet wrench wherein the usual pawl member associated with the usual ratchet wheel located in the head end of an elongate, ratchet wrench body is rotated either clockwise or counterclockwise from one end position to an opposite end position for reverse wrench operation by an elongate, change-over finger that extends longitudinally of the wrench body to the handle end thereof and is pivotally mounted as a lever relative to the wrench body. The work arm end of the lever preferably freely engages a recess or notch in the pawl, while the power arm end of the lever preferably engages a resiliently urged ball detent for snap action in moving from one end position to the opposite end position, alternately, under the control of preferably opposite push button ends of a slide actuator located near the handle end of the wrench body for pressing by a finger of the one hand of a user holding the wrench by such handle end. The wrench body is preferably of composite formation, having a major, longitudinal, body part made of plastic and having mutually opposite faces that are advantageously shallowly recessed to provide plane longitudinal surfaces against which face plates of strong and durable material, preferably steel, are secured for supporting operative parts of the wrench.

17 Claims, 1 Drawing Sheet

REVERSIBLE RATCHET WRENCH

This is a continuation, of application Ser. No. 816,149, filed Jan. 3, 1986, now abandoned.

BACKGROUND OF THE INVENTION

1. Field

The invention is in the field of reversible ratchet wrenches and is concerned with structural improvements therein making for easier operation, more rugged construction, and economy of production.

2. State of the Art

Reversible ratchet wrenches are well known and widely used. They enable an applied rocking motion to be converted to rotary motion for performing work, such as the screwing of nuts onto or off of bolts, etc. Reverse operation, as from clockwise rotation to counterclockwise rotation and vice versa, is accomplished by changing the position of a pawl relative to a ratchet wheel.

In general, ratchet wrenches comprise an elongate, rigid, wrench body having, at one end, a driving member for engaging the work and, at the other end, a handle for applying the rocking motion to the driving member. A ratchet wheel is associated with the driving member at the one i.e. head end of the wrench body and a reversibly positionable, resiliently biased pawl is associated with the ratchet wheel for effecting rotation of the ratchet wheel either clockwise or counterclockwise, depending upon the position of the pawl, as rocking motion is applied to the other i.e. handle end of the wrench body.

As ordinarily constructed, the position of the pawl is changed manually by means of a change-over device extending exteriorly of the wrench body for actuation by a hand or finger of the user. In certain known constructions, the change-over device is located either at the head end of the wrench body, as in U.S. Pat. Nos. 4,277,990, 3,467,231, and 3,233,481, for direct action on the pawl, or at the handle end of the wrench body confronting the terminus of such handle end, as in U.S. Pat. Nos. 4,308,769 and 3,650,165, for action on the pawl through the intermediacy of an alongate change-over element extending longitudinally within the handle, which is hollow. In either instance, the use of two hands by the user is necessary as a practical matter to effect change-over.

U.S. Pat. No. 3,608,402 discloses a ratchet wrench having a hollow wrench body with a rotatable handle end portion operable on an elongate change-over element extending longitudinally within the wrench body, while U.S. Pat. No. 4,277,989 discloses a wrench body which is hollow intermediate the head and handle ends and contains an elongate change-over element extending longitudinally therewithin and terminating at the handle end in a change-over button exteriorly of the wrench body that can be moved longitudinally in opposite directions by a finger of the hand holding the wrench to effect change-over. To somewhat similar effect is the construction in U.S. Pat. No. 4,300,413.

While the ratchet wrenches of the last three patents are conceivably operable by a single hand of the user, they still leave room for a construction, such as that of the present invention, providing for more convenient single hand operation. Moreover, the internal operating parts of these known ratchet wrenches are quite expensive to fabricate and assemble and leave something to be desired in the way of ruggedness and durability.

BRIEF SUMMARY OF THE INVENTION

In accordance with the present invention, ease and positivity of single hand operation and ruggedness and durability are acchieved by the provision of operative components that are supported by an elongate wrench body, which is preferably hollow as a housing therefor. Both a ratchet wheel and a pawl member are located at the head end of the wrench body in operative association with the driving member, and an elongate, rigid, change-over finger extends longitudinally with the wrench body and is transversely pivoted relative thereto. A change-over actuator extends transversely of the handle portion and preferably projects at either side of such handle portion alternately, depending upon the desired direction of rotary movement of the work-engaging driving member. The change-over finger preferably extends through the change-over actuator from engagement with resilient means in the handle portion of the wrench body to operative engagement with the pawl member, being fulcrumed as a lever intermediate its length between change-over actuator and pawl member for effecting the aforementioned transverse pivoting.

The change-over finger is preferably a rhombic-shaped lever bar having pairs of plane surfaces diverging from respective opposite ends thereof to a relatively thick intermediate portion, which provides vertices serving as fulcrums intermediate power and work arms of the lever and relative to mutually parallel plane surfaces that define a longitudinal, lever-bar-accommodating chamber internally of the wrench housing, such surfaces being in conformity with the corresponding plane surfaces of the lever bar for flatwise, face-to-face engagement therewith, respectively, in alternate positions of the lever bar.

The change-over actuator is preferably a slide operably placed in a corresponding passage formed transversely across the interior of the wrench housing and accommodating the power arm of the lever bar, which extends therethrough and terminates at the resilient means. The resilient means is advantageously a coil spring housed in a continuation of the lever-bar-accommodating chamber and capped by a ball that is engaged by the terminus of the power arm of the lever bar.

Engagement of the terminus of the work arm of the lever bar with the pawl member is preferably by projection into a recess in the pawl member formed by two substantially mutually perpendicular surfaces. Such surfaces are engaged alternately by the terminal end of the work arm for moving the pawl member into one or the other of its operative positions relative to the ratchet wheel.

For economy of fabrication and reduction in weight, without sacrificing ruggedness and effective operation, it is preferred that the wrench body be molded from a plastic material and faced by plates of a strong and durable material, such as steel, which serve to mount and support internal operative parts.

THE DRAWING

The best mode presently contemplated of carrying out the invention is illustrated in the accompanying drawing, in which:

FIG. 1, represents a longitudinal axial section through a typical reversible wrench of the invention having a hollow wrench body fabricated from injection molded plastic and from rigid and durable facing plates; and FIG. 2, a plan view drawn to a larger scale with proximate facing plate removed to show internal parts, portions of the pawl member and change-over actuator slide being broken away so that the remainder appears in section.

DETAILED DESCRIPTION OF THE ILLUSTRATED EMBODIMENT

Figure 1:
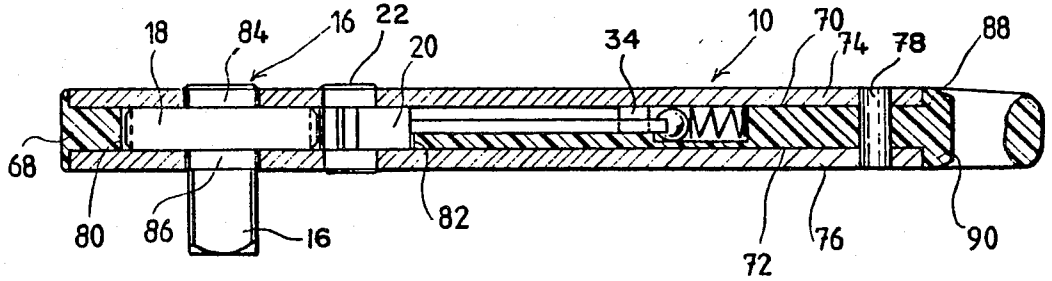

As illustrated, the reversible ratchet wrench comprises a hollow body 10 having a head portion 12 and a handle portion 14. A driving member 16, arranged to be coupled to the work in usual manner, is rotatably mounted in the head portion 12. A ratchet wheel 18 is provided on the driving member 16 within the housing provided by hollow body portion 10. A pawl member 20 is also provided in the housing head portion and arranged for rotary movement between two end positions that determine whether the driving member is to be rotated clockwise or counterclockwise. As shown, rotary movement of ratchet wheel 18 is locked in clockwise direction. Ratchet wheel 18 and pawl member 20 are provided with teeth 18*a* and 20*a*, respectively, for interengagement in conventional manner. The lines of action of the forces transmitted by the flanks of the interengaged teeth run substantially through the mounting shaft 22 of pawl member 20. On the other hand, pawl member 20 can yield with opposite rotational movement of the ratchet wheel 18 relative to housing 10. The lines of action of the forces transmitted through the teeth-flanks run substantially tangentially to the mounting shaft of pawl member 20. An inverse situation exists in the other end position of pawl member 20. There, ratchet wheel 18 is locked in counterclockwise direction, whereas the ratchet wheel 18 is released in clockwise direction.

A detent spring 24 is provided, through which the pawl member 20 is resiliently held in one end position or the other preferably in a way to be described hereinbelow.

A change-over finger 26, extends between head portion 12 and handle portion 14 in the interior of housing 10. One end 28 of the change-over finger engages pawl member 20 and is arranged to rotate the pawl member from one end position to the other. Furthermore, a change-over actuator device 30 is arranged transversely in handle portion 14 and engages change-over finger 26. This change-over device is arranged to move pawl element 20 from one end position to the other through change-over finger 26.

As shown, change-over finger 26 is in the form of a lever bar having work arm and power arm portions 28 and 32, respectively, diverging from rounded ends toward a relatively thick intermediate portion having mutually opposite vertices 29 which are pivotable as fulcrums between two positions inside housing 10, each of these positions being associated with one end position of pawl member 20. Detent spring 24 engages the rounded end of power arm 32 that is remote from pawl member 20 and hold the change-over finger in one or the other of its two positions.

Change-over device 30 comprises an actuator slide 34 slidably positioned in a corresponding transverse passage in handle portion 14.

Pawl member 20 has a recess 36 in its circumference into which the rounded end portion 28 of change-over finger i.e. lever bar 26 projects. Such recess is of generally triangular formation and has two surfaces 38 and 40 substantially perpendicular to each other. The end 28 of change-over finger 26 resiliently engages, in both of its positions, one or the other of surfaces 38 and 40.

A longitudinal chamber 42 is defined within wrench body 10 by two longitudinal surfaces 44 and 46 extending parallel with each other. The lever bar configuration of change-over finger 26 is of generally elongated-rhombic shape, having opposite pairs of divergent, plane, lateral surfaces 48 and 50 and 52 and 54. Finger 26 is arranged in longitudinal chamber 42, such that, in one position, illustrated in FIG. 2, the pair of diametrically opposite lateral surfaces 48 and 52 engage longitudinal surfaces 44 and 46, respectively, of the chamber in flatwise, face-to-face relationship, while, in the other position, the other pair of diametrically opposite lateral surfaces 54 and 50 similarly engage longitudinal surfaces 44 and 46, respectively, of the chamber.

A ball 58, loaded by detent spring 24, is provided in an end face 56 of longitudinal chamber 42 at its end that is remote from head portion 12. A relatively narrow extension 60 of chamber 42, having a semi-cylindrical bottom, serves to house and guide coiled detent spring 24, which is capped by ball 58. Detent spring 24 is biased to urge ball 58 toward head portion 12.

In each of the two positions of change-over finger 26, its end 32 that is remote from pawl member 20 is located between ball 58 and one or the other longitudinal surface, e.g. the surface 46 as shown, which defines longitudinal chamber 42, such that detent spring 24 exerts a force on change-over finger 26 that is directed toward the pawl member. Thus, ball 58 not only defines the two positions snapped into by change-over finger 26, but also transmits an axial force on such change-over finger by which pawl member 20 is resiliently held in engagement with ratchet wheel 18. If such ratchet wheel rotates counterclockwise in FIG. 2 relative to housing 10, the teeth of pawl member 20 are urged by this resilient force out of engagement with the teeth of the ratchet wheel, but this engagement will be re-established at once.

Figure 2:
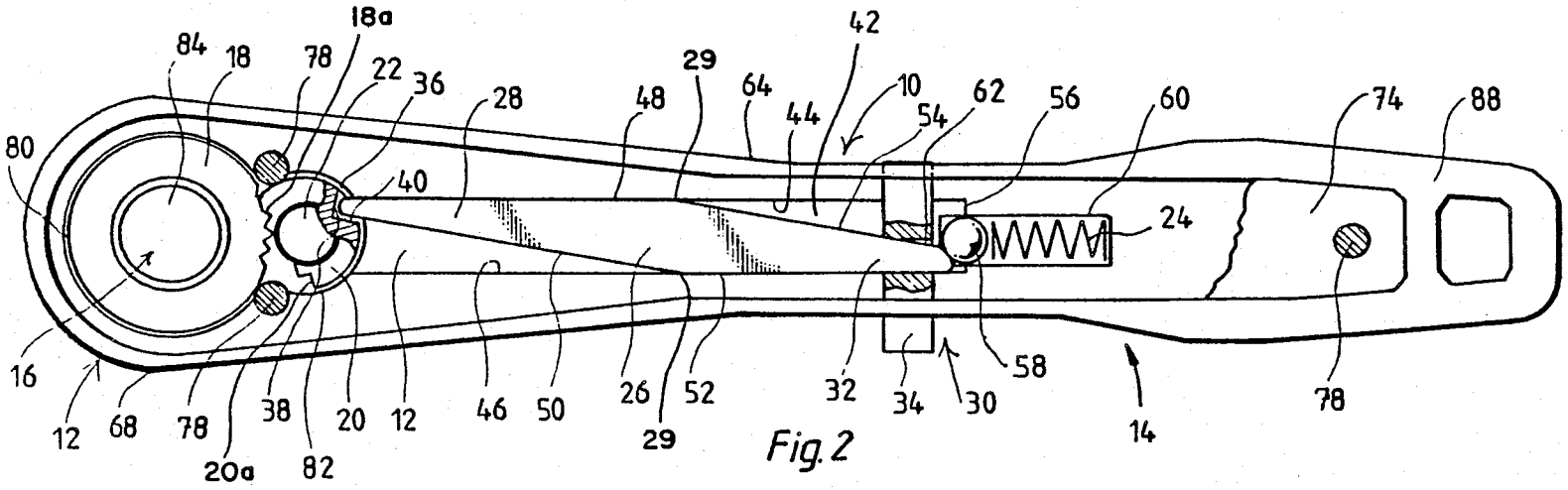

Actuator 34 is a slide guided at right angles to the longitudinal axis of wrench body 10 and to its longitudinal chamber 42. This slide is provided with an aperture 62 through which change-over finger 26 extends, so that its end 32 faces ball 58. Thereby, two alternate positions of actuator 34 determine the two positions into which change-over finger 26 is snapped. In each of these two positions, one or the other end of actuator 34 projects as a push button from a lateral outer surface, see 64 of FIG. 2, of the wrench body. Change-over from one direction of operation to the reverse direction is then effected by pressing the projecting push buttom portion of actuator slide 34. This would pivot change-over finger 26 and force end 32 thereof to urge ball 28 against detent spring 24, compressing it within recess 60 until dead center is passed. As shown in FIG. 2, actuator slide 34 would be pressed upwardly and change-over finger 26 would be pivoted counterclockwise so that its end 32 would move upwardly. After passing dead center, ball 58 would engage the lower surface of change-over finger 26.

Pressing of the now upwardly projecting (in FIG. 2) push button portion of actuator slide 34 would then pivot change-over finger 26 clockwise to reverse the action of its end 28 on pivot member 20. As change-over finger 26 would be thus repositioned, the lateral surface 54 of its work arm 32 would engage longitudinal surface 44 of longitudinal chamber 42 and the lateral surface 50 would engage the longitudinal surface 46, rather than being positioned as shown in FIG. 2. By this clockwise pivotal movement of change-over lever 26, with its thick intermediate portion 66 serving as a fulcrum relative to the mutually parallel interior walls 46 and 48 of longitudinal chamber 44, pawl member 20 would be rotated clockwise into the end position thereof opposite to that shown in FIG. 2, wherein its teeth 20*a* would engage the teeth 18*a* of ratchet wheel 18 below the center line in FIG. 2. Now, counterclockwise rotational movement of ratchet wheel 18 would be locked relative to wrench body 10.

A rugged and durable, composite wrench body that is especially lightweight and easy to produce is obtained by making its major part 68 of a suitable plastic material, FIG. 1, such as a polyamide. As so made, the plastic part 68 has opposite, parallel, plane surfaces 70 and 72 adapted to be faced by a pair of rigid plates 74 and 76, respectively, which are then connected to each other and to the plastic part 68 by attachment members, e.g. rivets 78. The plates 74 and 76 are preferably steel, which represents a rigid material of high resistance to wear and highly resistant to deflection from planar configuration. In the area of the driving member 16, the plastic part 68 has a circular aperture 80 and a communicating aperture 82. A recess forming the longitudinal chamber 42 is provided adjacent aperture 82 in one of the faces, here shown in the face 70, of the plastic part 68. Such apertures and recesses are covered by the rigid plates. Ratchet wheel 18 is rigidly fixed on driving member 16 and positioned in aperture 80, with shaft portions 84 and 86 of the driving member extending through and journaled in plates 74 and 76, respectively, and with the work-engaging portion thereof projecting outwardly as shown in FIG. 1. Pawl member 20 is similarly positioned in aperture 82, being rotatably mounted in plates 74 and 76 by means of its shaft 22.

Plastic part 68 is shallowly recessed at opposite faces thereof to provide the plane surfaces 70 and 72 for receiving plates 74 and 76, respectively, the plates 74 and 76 being surrounded by side walls 88 and 90, respectively, of plastic that define the shallow, plate-receiving recesses. Thus a very rigid, rugged, and solid structure of light weight results.

This composite construction for a ratchet wrench body constitutes an aspect of the invention that has application to ratchet wrenches in general, regardless of the specific type of operative mechanism.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. In a reversible ratchet wrench having an elongate wrench body with a head end portion and a handle end portion, a driving member in the head end portion for engaging work to be rotated, a ratchet wheel in the head end portion for rotating the driving member, and a pawl member associated with the ratchet wheel and rotatably mounted in the head end portion and movable between two end positions in engagement with said ratchet wheel, so that rocking motion applied to the handle end portion in one direction will rotate the driving member clockwise and in the opposite direction will rotate the driving member counterclockwise, the combination of a rigid, elongate, change-over finger in the nature of a lever extending longitudinally along the wrench body from the handle end portion to the head end portion thereof, said finger being pivotally mounted and longitudinally movable relative to the wrench body and having one end portion engaging the pawl member and being transversely movable as a work arm between two positions corresponding to the respective end positions of the pawl member for shifting the pawl member from one end position to the other end position thereof and vice versa; means between said change-over finger and opposing interior walls of said wrench body providing for fulcruming said finger relative to said wrench body during pivotal movement of said finger; actuating means for the change-over finger adjacent to the handle end portion of the wrench body for actuation by the hand of a user holding the handle end portion of the wrench body to move the opposite end portion of said finger as a power arm; and resilient means acting on the change-over finger to hold the pawl member in one or the other of its end positions and to urge said finger longitudinally into engagement with said pawl member.

2. The combination set forth in claim 1, wherein the pawl member is recessed at its circumference, and the one end of the change-over finger engages the pawl by extending freely into the recess for pushing against a wall thereof when the change-over finger is pivotally moved by the actuator slide.

3. The combination set forth in claim 2, wherein the recess is of generally triangular formation having two walls intersecting each other at substantially right angles and facing the directions of movement, respectively, of the one end of the change-over finger, for engagement of one or the other of said walls by said end of the change-over finger during pivotal movement of the change-over finger.

4. The combination set forth in claim 1, wherein the resilient means is disposed within the handle portion of the wrench body and includes a ball engaged by the opposite end of the change-over finger and over which it passes as said finger executes its transverse pivotal movement, so said finger will be snapped into one or the other of its end positions.

5. The combination set forth in claim 1, wherein the wrench body has a pair of mutually opposite, parallel, interior walls extending as planes longitudinally; the change-over finger is formed as a lever bar of elongate, generally rhombic shape having opposite end portions that diverge along opposite plane surfaces as the power arm and the work arm, respectively, to a relatively thick intermediate portion having oppositely placed vertices serving as the fulcruming means for pivoting said bar against said interior walls of the wrench body so corresponding pairs of said plane surfaces of the lever bar and of portions of said interior surfaces of the wrench body will come into flatwise, face-to-face engagement alternately upon pivotal movement of the change-over finger.

6. The combination set forth in claim 1, wherein the wrench body is hollow; the change-over finger extends within and is pivoted in the wrench body; and the actuating means for the change-over finger is a slide mounted in the wrench body for back and forth sliding movement transversely across the interior of said body, the opposite end portion of the change-over finger extending into engagement with the slide for being pivotally moved thereby.

7. The combination set forth in claim 6, wherein the power arm extends through and beyond said slide to termination in an end of said power arm located beyond said slide and bearing against the resilient means.

8. The combination set forth in claim 6, wherein the actuating slide projects at one or the other of the lateral sides of the wrench body as a push button for pressing by a finger of the hand of the user holding the handle end portion of the wrench body.

9. The combination set forth in claim 1, wherein the wrench body is of composite formation, with a major longitudinal body part made of plastic having mutually opposite, plane, longitudinal surfaces and with face plates of a strong and durable material secured against said plane faces, respectively, of the plastic body part.

10. The combination set forth in claim 9, wherein the major, longitudinal body part of plastic is shallowly recessed at its opposite faces; and the plates are fitted into the recesses.

11. The combination set forth in claim 9, wherein the major, longitudinal body part of plastic is apertured at the head end of the wrench body to receive the ratchet wheel and the pawl member, respectively, and is deeply recessed longitudinally therefrom for receiving the change-over finger; and wherein the aperatures are covered by the face plates and the deep recess is covered by one of the face plates.

12. The combination set forth in claim 11, wherein the major, longitudinal, body part is further deeply recessed at the handle end of the wrench body as a relatively narrow extension of the change-over-finger-receiving recess for receiving a coil spring and a ball as the resilient means to provide snap action for the change-over finger; the extension of the change-over-finger-receiving recess being also covered by the one face plate to hold both spring and ball in place.

13. The combination set forth in claim 9, wherein both the ratchet wheel and the pawl member are rotatably mounted in the face plates.

14. The combination set forth in claim 9, wherein the face plates are steel.

15. The combination set forth in claim 11, wherein both the ratchet wheel and the pawl member are rotatably mounted in the face plates.

16. The combination set forth in claim 15, wherein the face plates are steel.

17. The combination set forth in claim 1, wherein the wrench body is of composite formation, with a major longitudinal body part made of a material of limited strength and durability and having mutually opposite, plane, longitudinal surfaces; face plates of a strong and durable material secured against said plane faces, respectively, of said body part; said body part being apertured at the head end of the wrench body to receive the ratchet wheel and the pawl member, respectively, and being deeply recessed longitudinally therefrom for receiving the change-over finger, the apertures being covered by the face plates and the deep recess being covered by one of the face plates, the ratchet wheel and the pawl member being rotatably mounted in the face plates; said plane surfaces and said face plates extending longitudinally over substantially the entire length of the wrench body, including said handle end portion, to reinforce and stabilize the wrench body for transmission of large forces.

* * * * *